US005690584A

United States Patent [19]

Strawcutter et al.

[11] Patent Number: 5,690,584

[45] Date of Patent: Nov. 25, 1997

[54] MULTI-DIRECTIONAL MOVABLE RECREATIONAL EQUIPMENT DEVICE

[75] Inventors: Grant M. Strawcutter; James O. Dunn, Jr., both of Charlotte; Todd A. Coble, Stanfield, all of N.C.

[73] Assignee: Soft Play, L.L.C., Charlotte, N.C.

[21] Appl. No.: 633,462

[22] Filed: Apr. 17, 1996

[51] Int. Cl.[6] ..... A63B 9/00; A63B 17/00

[52] U.S. Cl. ..... 482/35; 482/36

[58] Field of Search ..... 482/23, 24, 35, 482/36; 472/95, 103, 104, 105, 116, 118, 135, 136, 77; 434/55, 58, 59, 247; 138/149

[56] References Cited

U.S. PATENT DOCUMENTS

| | | | |
|---|---|---|---|
| 2,705,144 | 3/1955 | Ridgway | 472/116 X |
| 3,578,381 | 5/1971 | Young . | |
| 3,886,607 | 6/1975 | Dunn | 472/135 |
| 3,936,140 | 9/1974 | Ahrens . | |
| 4,379,550 | 4/1983 | Petersen . | |
| 4,410,014 | 10/1983 | Smith | 138/149 |
| 4,629,182 | 12/1986 | Radar et al. | 482/35 |
| 4,995,603 | 2/1991 | Reed . | |
| 5,062,624 | 11/1991 | Reed . | |
| 5,226,864 | 7/1993 | Showers | 482/35 |
| 5,387,165 | 2/1995 | Warren | 482/35 |

FOREIGN PATENT DOCUMENTS

| | | | |
|---|---|---|---|
| WO 94/12241 | 6/1994 | WIPO | 482/35 |

OTHER PUBLICATIONS

Miracle Recreation Equipment Company 1995 Park & Playground Catalog, pp. 79–80.

Soft Play, L.L.C.'s 1995 "Value Series" brochure dated 1995.

*Primary Examiner*—Richard J. Apley
*Assistant Examiner*—William LaMarca
*Attorney, Agent, or Firm*—Polster, Lieder Woodrff and Lucchesi, llc

[57] ABSTRACT

A movable recreational equipment device is disclosed. The device includes an enclosure having at least one opening for entry of an occupant and a support for suspending the enclosure above a floor or ground surface. The support and enclosure are constructed and connected to one another to permit controlled fluid movement of the enclosure relative to the support. The enclosure has controlled fluid or resilient mounting relative to the support in order to permit controlled fluid or resilient movement of the enclosure relative to the support when an occupant enters the enclosure. Preferably, the enclosure provides controlled fluid or resilient multi-directional movement of the enclosure relative to the support. The device may be connected to one or more flexible tubes in a recreational play system environment to enable movement of the enclosure while remaining connected to the flexible tubes.

15 Claims, 4 Drawing Sheets

MULTI-DIRECTIONAL MOVABLE RECREATIONAL EQUIPMENT DEVICE

CROSS REFERENCE TO RELATED APPLICATION

This is copending patent application of the following commonly assigned patent applications: Ser. No. 08/634,044, filed Apr. 17, 1996 entitled VERTICALLY MOVABLE RECREATIONAL EQUIPMENT DEVICE, Ser. No. 08/633,587, filed Apr. 17, 1996 entitled LATERALLY MOVABLE RECREATIONAL EQUIPMENT DEVICE, Ser. No. 08/633,662, filed Apr. 17, 1996 entitled MOVABLE OCCUPANT DIRECTED RECREATIONAL EQUIPMENT DEVICE, and Design patent application Ser. No. 29/055,394, filed Jun. 5, 1996 entitled MULTI-DIRECTIONAL MOVABLE RECREATIONAL EQUIPMENT DEVICE.

BACKGROUND OF THE INVENTION

Children's outdoor playground or recreational equipment that facilitates movement is quite popular. In addition to swing sets, rotating or whirling devices and teeter-totters, children love to sit on spring mounted riders that have various animal and other shapes. Typically, such spring mounted riders have coil springs or leaf springs that extend between the ground and the rider. As a result, children can sit on the rider and create their own bouncing and rocking movements. Examples of such devices are shown in U.S. Pat. Nos. 3,578,381; 3,836,140; 4,379,550; and in the Miracle Recreation Equipment Company 1995 Park and Playground Catalog at pages 79–80.

Children's indoor playground or recreational equipment does not readily offer various moving type play devices. Space, along with safety, restricts the availability of various types of movable recreational equipment. This is also true of tubular play systems and enclosures through which children crawl or move, such as shown, for example, in Soft Play, L.L.C.'s 1995 "Value Series" brochure. Where an indoor recreational play system includes such tube and junction boxes or other enclosures through which children crawl or move, it would be desirable to provide movement of the junction box, enclosures or other elements. Although children enjoy being confined in a mirage or tubes and enclosures in such tubular play equipment, in order to create a more interesting environment, it has been discovered that it is possible to provide for movement of the enclosures or other elements, while enabling such elements to remain connected to generally flexible parts in the tubular play equipment.

There are some rotating and tilting enclosures which are separate, free standing devices, including for example, U.S. Pat. Nos. 4,995,603 and 5,062,624. However, when enclosures are part of a recreational play system that includes connected tubes and enclosures, it would be particularly desirable to provide for movement of the enclosures or other elements, while enabling same to remain connected to generally flexible tubes or other components in the tubular play equipment.

The present invention relates, in its broadest terms, to a movable recreational equipment device, as well as to a multi-directional movable recreational equipment device, as compared to the vertically movable recreational equipment device and laterally movable recreational equipment devices of my aforementioned patent applications.

SUMMARY OF THE INVENTION

Accordingly, among the several objects and advantages of the present invention include:

The provision of a movable recreational equipment device;

The provision of the aforementioned movable recreational equipment device which allows for movement of the device while remaining connected to flexible tubular elements or other parts in a tubular play equipment system;

The provision of the aforementioned movable recreational equipment device which provides for controlled fluid or resilient movement of the movable recreational equipment device while being suspended relative to a support;

The provision of the aforementioned movable recreational equipment device in which entry of an occupant provides controlled fluid or resilient movement relative to the support;

The provision of the aforementioned movable recreational equipment device which provides smooth and safe movement in a controlled environment;

The provision of the aforementioned movable recreational equipment device which also can provide multi-directional movement of the device relative to the support;

The provision of the aforementioned movable recreational equipment device which also can provide controlled fluid or resilient multi-directional movement of the device relative to the support; and The provision of the aforementioned movable recreational equipment device which can be quickly and economically manufactured; is easy to use and maintain; is made of a minimum number of parts; is safe in operation; and is otherwise well adapted for the purposes intended.

Briefly stated, the movable recreational equipment device of the present invention includes an enclosure having at least one opening for entry of an occupant. A support suspends the enclosure above a floor or ground surface. Means are provided for controlled fluid mounting of the enclosure relative to the support in order to permit controlled fluid movement of the enclosure relative to the support when an occupant enters the enclosure.

The movable recreational equipment device permits controlled fluid movement of the enclosure relative to the support in any predetermined path or, if desired, in a plurality of predetermined paths. As such, the movable recreational equipment device is thus capable of moving in generally opposed directions in any predetermined path or in a plurality of opposed directions extending generally transverse to or at an angular relative to one another.

The movable recreational equipment device may be operated by itself, although preferably, it is part of a recreational play system environment. When used in a recreational play system environment, the enclosure of the movable recreational equipment device is connected to flexible components while permitting movement of the enclosure relative to such other components. For example, the enclosure may be connected to one or more flexible tubes in a tubular recreational play system in which the enclosure is moved relative to the support without disconnection from the flexible tubes that form part of the tubular recreational play system.

The means for controlled fluid mounting of the enclosure relative to support may provide controlled fluid movement of the enclosure relative to the support in a single predetermined path or a plurality of paths providing multi-directional movement of the enclosure relative to the support.

The enclosure and support are constructed and connected to one another through the means to facilitate controlled fluid movement of the enclosure relative to the support.

The enclosure may be constructed in any shape or configuration for movement in a predetermined path, although preferably, the enclosure includes an enclosed center section with interconnected outwardly extending spaced tubular leg sections. The means facilitating controlled fluid movement of the enclosure relative to the support extends between the enclosed center section of the enclosure and the support. Specifically, the means facilitating controlled fluid movement of the enclosure relative to the support extends from generally opposite areas of the enclosed center section and the support.

A spaced pair of coil springs on each side of the center section may be provided for the controlled fluid movement of the enclosure relative to the support. The spaced coil springs may be attached to the enclosed center section at one end and to a vertical support element at an opposite end. The enclosed center section may include two half sections which are joined together by a surrounding flange with each pair of spaced coil sections being attached at one end of the surrounding flange.

A spring mounted cable may extend between the enclosed center section and the support with the cable being located between and substantially below each pair of spaced coil springs to facilitate multi-directional movement while stabilizing the enclosure relative to the support.

These and other objects and advantages of the present invention will become apparent from the description that follows.

BRIEF DESCRIPTION OF THE DRAWINGS

In the drawings.

Corresponding reference numerals will be used throughout the several figures of the drawings.

DESCRIPTION OF THE PREFERRED EMBODIMENTS

The following detailed description illustrates the invention by way of example and not by way limitation. This description will clearly enable one skilled in the art to make and use the invention, and describes several embodiments, adaptions, variations, alternatives and uses of the invention, including what I presently believe is the best mode of carrying out the invention.

Figure 8:
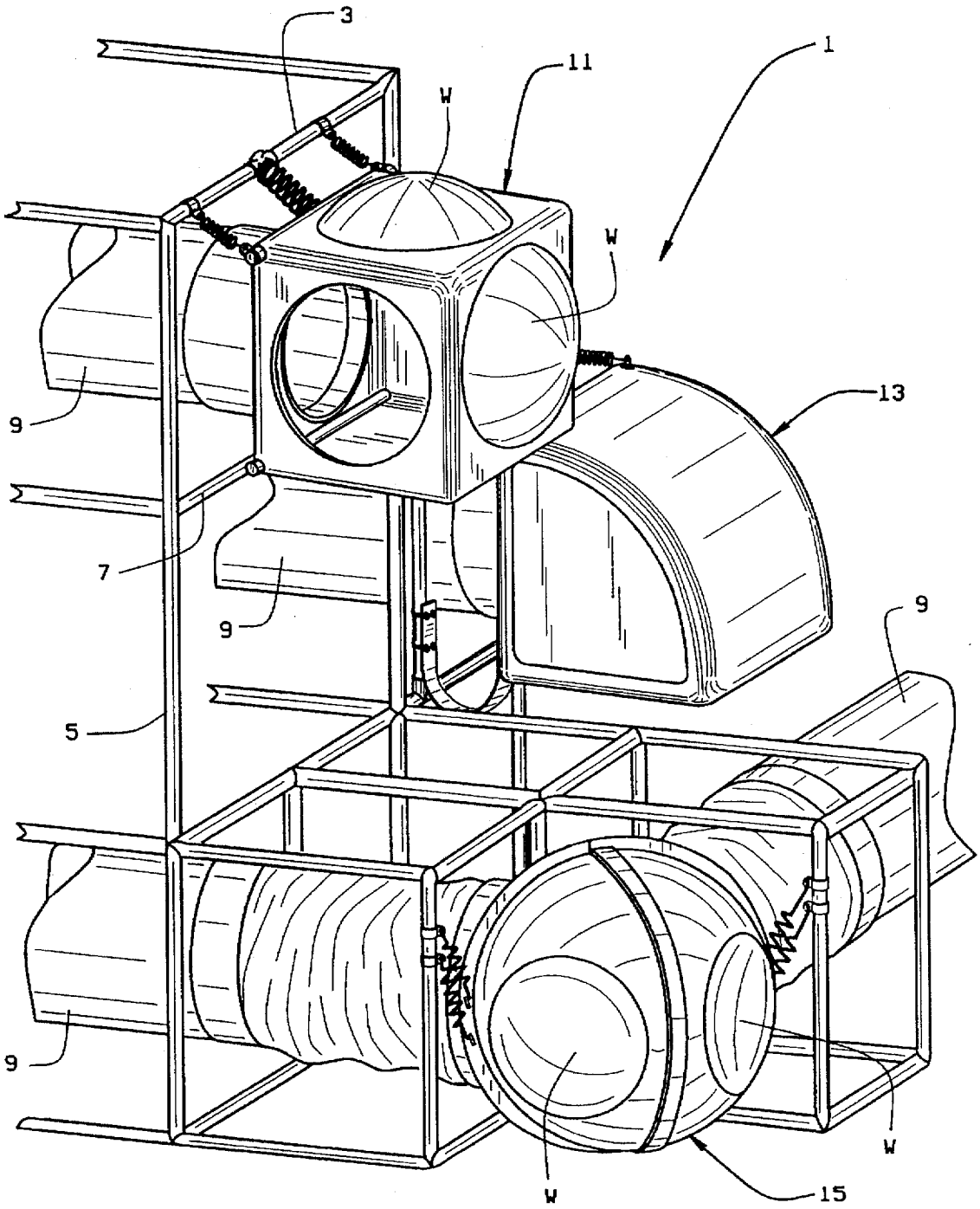
FIG. 8 is a perspective view of a typical tubular play system environment, including a plurality of tubes and enclosures, as well as the movable recreational equipment device of the present invention.

In order to understand a typical and preferred recreational play system in which the movable recreational equipment device of the present invention may be used, reference is first made to FIG. 8 of the drawings.

As illustrated in FIG. 8, a recreational play system 1 may include a supporting structure 3 having a series of interconnected vertical struts 5 and horizontal struts 7 for supporting an interconnected tubular and enclosure play structure. The interconnected tubular and enclosure play structure may include interconnected elongated tubes 9 and enclosures 11, 13 and 15 which are arranged at various respective heights in the supporting structure 3, or in any other desired arrangement. The interconnected tubes 9 and the enclosures 11, 13 and 15 enable children to crawl or move through the interconnected tubes and enclosures for a fun play experience. The enclosures 11, 13 and 15 may be connected to one or more tubes 9 and may include the use of transparent windows W in the enclosures, as illustrated in each of the enclosures 11 and 15.

Typically, the enclosures 11, 13 and 15 have been static structures in that they have been attached in a fixed position to the vertical struts 5 and/or horizontal struts 7. However, it is possible to construct the suspended enclosures 11, 13 and 15 in order to provide a safe and controlled fluid or resilient movement in one or more directions, in order to enhance the play experience of children when entering the enclosures 11, 13 and 15. At the same time, the enclosures remain connected to the tubes 9, as will be apparent.

Each of the enclosures 11, 13 and 15 are the subject of separate patent applications as follows: enclosure 11 is the subject of co-pending patent application Ser. No. 08/633,587 filed Apr. 17, 1996 entitled LATERALLY MOVABLE RECREATIONAL EQUIPMENT DEVICE, enclosure 13 is the subject of co-pending patent application Ser. No. 08/634,044 filed Apr. 17, 1996 entitled VERTICALLY MOVABLE RECREATIONAL EQUIPMENT DEVICE, and enclosure 15 is the subject of the present patent application and is directed to the movement of the enclosure in a single predetermined path or in a plurality of paths, as will be apparent from the description that follows. It is to be also understood that in the discussion that follows, the term "fluid" or "resilient" mounting is defined as a movable and/or changeable mounting structure, and includes resilient devices such as springs or other shock absorbing elements, as well as fluid (air or liquid) cylinders or other structure, which are able to move and change shape without separating under force or pressure. In the same sense, the term "fluid" or "resilient" movement is defined to include movable and/or changeable positions or movement along a predetermined path.

Figure 1:
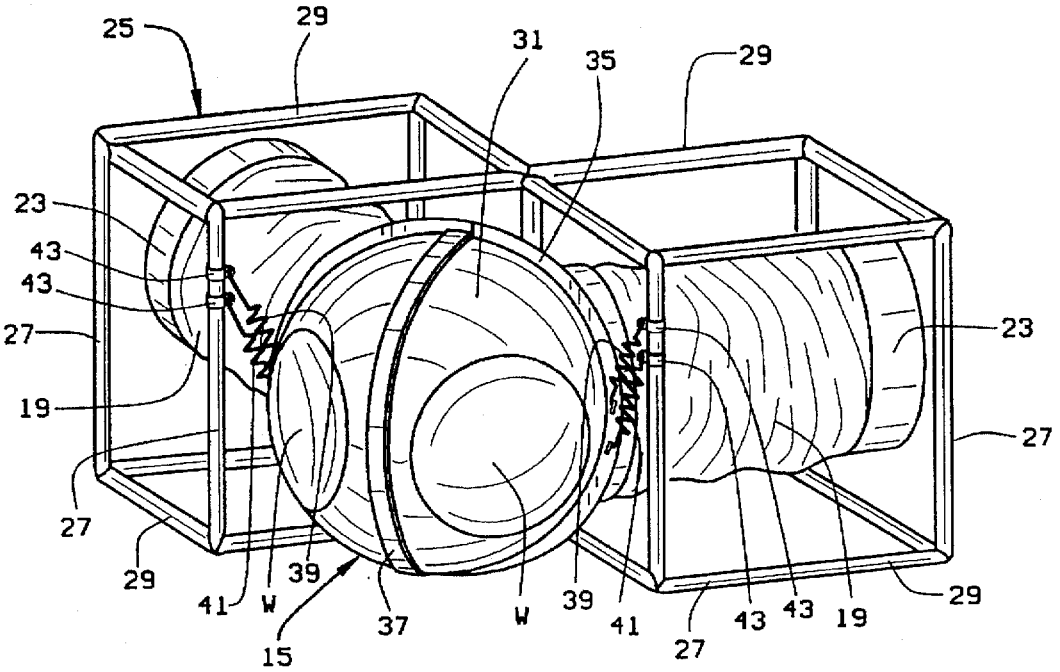
FIG. 1 is a rear perspective view of the movable recreational equipment device of the present invention.
Figure 2:
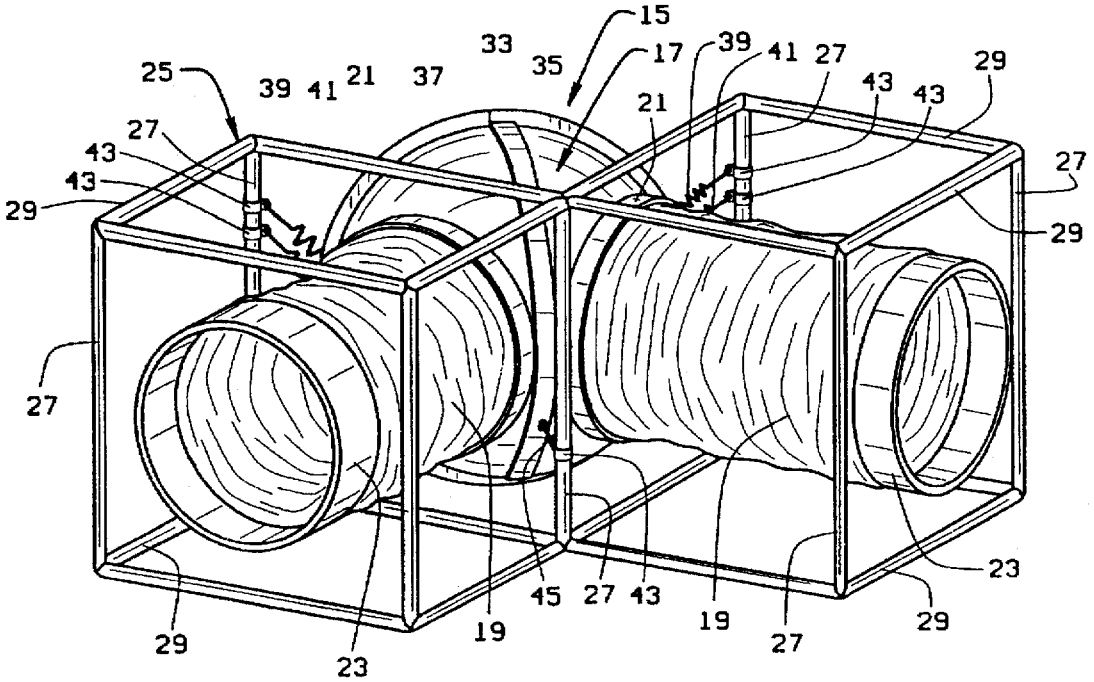
FIG. 2 is a from perspective view of the movable recreational equipment device of the present invention.
Figure 3:
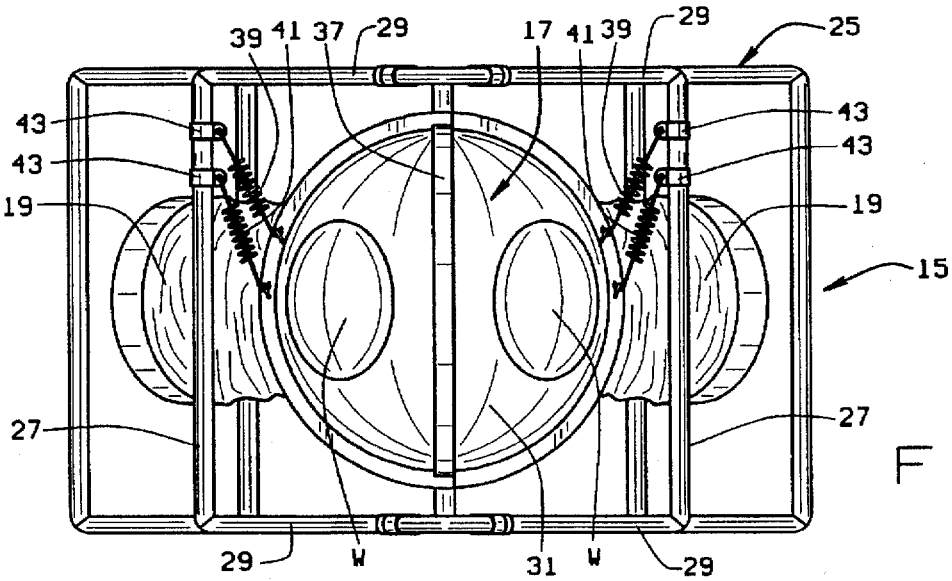
FIG. 3 is a front elevational view of the movable recreational equipment device when in a stable of fixed position.

The movable recreational equipment device 15 of the present invention includes an enclosure 17 which is interconnected to outwardly extending spaced tubular leg sections 19, 19. As best illustrated in FIG. 2 of the drawings, the enclosure 17 includes spaced angularly offset connective tubular necks 21 which receive the spaced tubular leg sections 19, 19. As illustrated in the drawings, each of the spaced tubular leg sections 19, 19 may be formed of a flexible web-like material and include an outer connected neck 23 for receiving a complementary shaped tube 9 in the tubular play system environment 1 as illustrated in FIG. 8 of the drawings.

For suspending the movable recreational equipment device 15, including the enclosure or center section 17 as well as the interconnected outwardly extending spaced tubular leg sections 19, 19, a support 25 is provided. The support 25 includes spaced vertical struts 27, 27 that are interconnected at opposite ends to spaced horizontal struts 29, 29 in the arrangement illustrated in the drawings. Other suitable arrangements are possible, depending upon the configuration of the movable recreational equipment device 15.

For purposes of the present invention, the movable recreational equipment device 15 includes the enclosure 17 as well as the interconnected outwardly extending spaced tubular leg sections 19, 19; however, it will be understood that the enclosure 17 may have any shape or configuration and may be used with or without the interconnected outwardly extending spaced tubular leg sections 19, 19.

In suspending the enclosure 17 of the movable recreational equipment device 15 above a floor or ground surface, certain of the vertical struts 27 of the support 25 are utilized, as will now be discussed in detail.

First of all, the enclosure 17 is illustrated in the drawings as having a generally spherical shaped configuration which is formed from two semi-spherical hollow shells 31, 33 formed from a suitable plastic material such as polyethylene. The semi-spherical shell 31 includes openings for receiving transparent windows W to enable an occupant within the enclosure 17 to see or be seen through the windows W. The other semi-cylindrical shell or section 33 includes connective necks 21, 21 for mounting the outwardly extending spaced tubular leg sections 19, 19.

The semi-spherical hollow shells 31, 33 are joined together by a cylindrical flange 35 that is bolted or otherwise secured to the semi-spherical shells 31, 33. In addition, a pair of semi-spherical straps 37 extend transversely relative to the circumferential strap 35 and interconnect generally opposed upper and lower areas of the circumferential flange 35 to one another, as best seen in FIGS. 1–2 and 6–7 of the drawings. As a result, the semi-spherical shells 31, 33 are laterally reinforced while providing suitable connecting areas for suspending the enclosure 17 relative to the support 25.

In order to provide movement of the enclosure 17 relative to the support 25, the movable recreational equipment device 15 includes means for controlled fluid or resilient mounting of the enclosure 17 relative to the support 25 in order to permit fluid or resilient movement of the enclosure 17 relative to the support 25 when an occupant enters or moves within the enclosure 17.

For this purpose, FIGS. 1–8 of the drawings illustrate the use of springs for the fluid or resilient mounting and movement of the enclosure 17 relative to the support 25. Specifically, a spaced pair of upper and lower coil springs 39, 41 are illustrated as extending between one of the vertical struts 27 of the support 25 and the circumferential flange 35 of the enclosure 17. One end of each of the spaced coil springs 39, 41, on opposite sides of the enclosure 17, are connected to the circumferential flange 35 while the other end is connected to straps 43 engaging the associated vertical strut 27.

Figure 6:
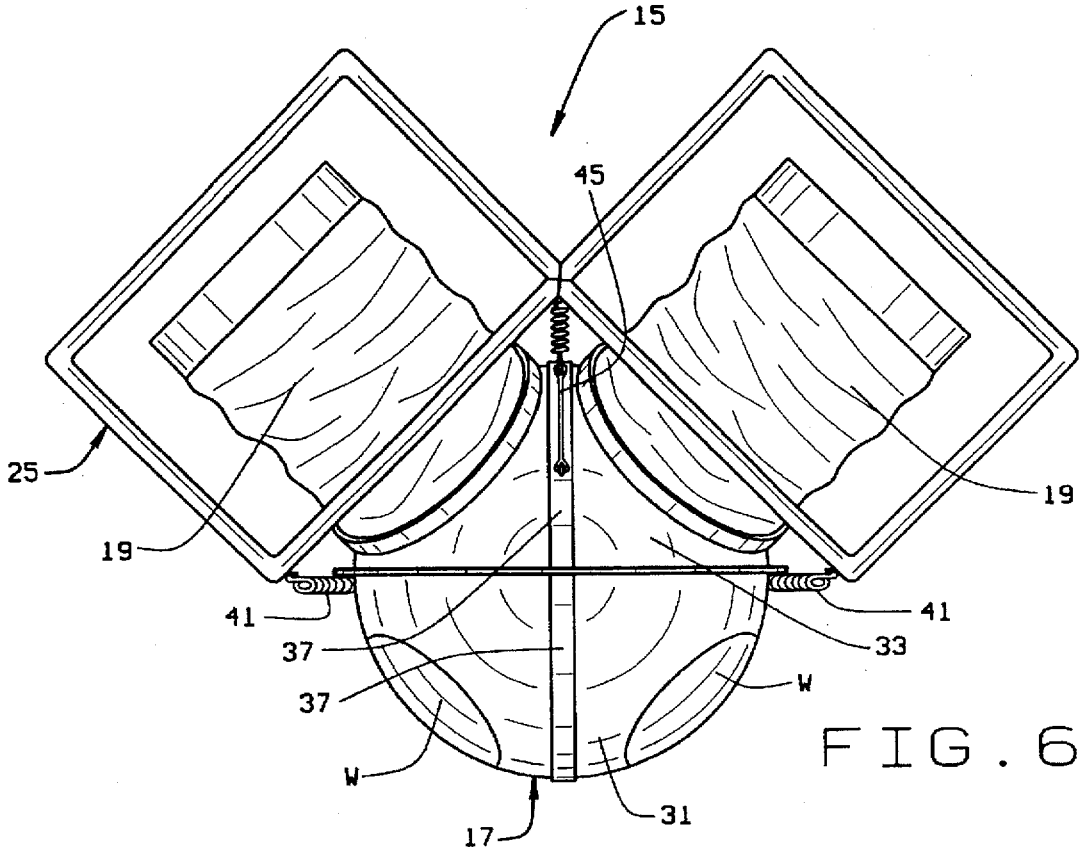
FIG. 6 is a bottom plan view of the movable recreational equipment device in a stable or fixed position.
Figure 7:
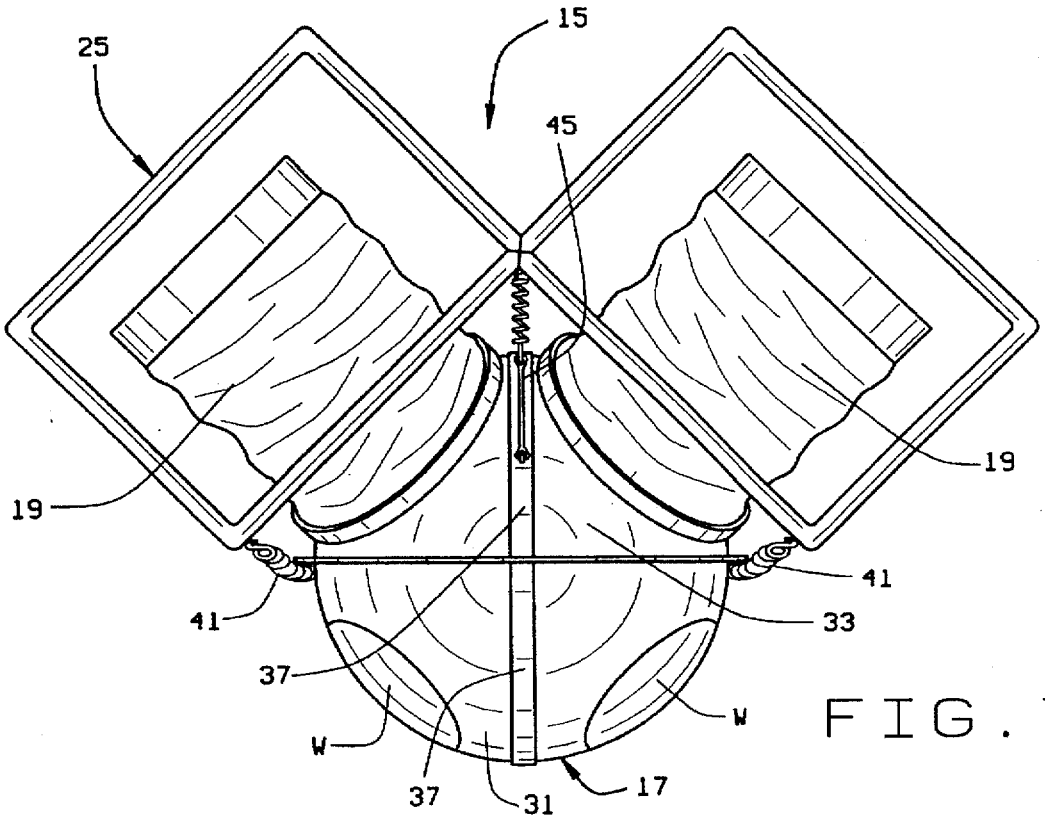
FIG. 7 is a bottom plan view of the movable recreational equipment device showing movement from an upper to a lower direction as seen in this Figure.

In addition to the spaced pairs of coil springs 39, 41 on each side of the enclosure 17, there is also provided a spring mounted cable 45 that extends between another vertical strut 27 of the support 25 and the rear semi-circular strap 37, as best seen in FIGS. 2 and 6–7 of the drawings.

Figure 4:
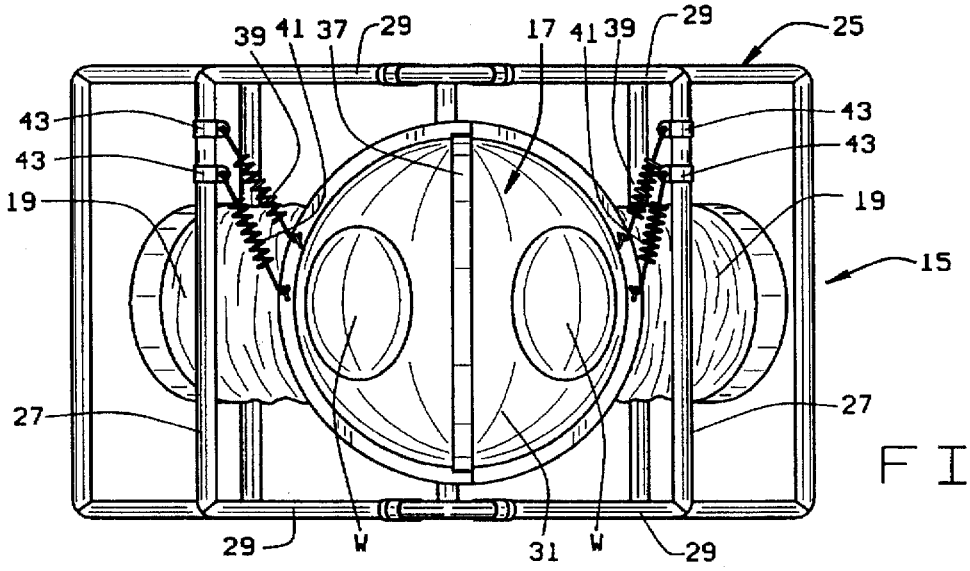
FIG. 4 is a front elevational view of the movable recreational equipment device illustrating movement of the device from left to right.
Figure 5:
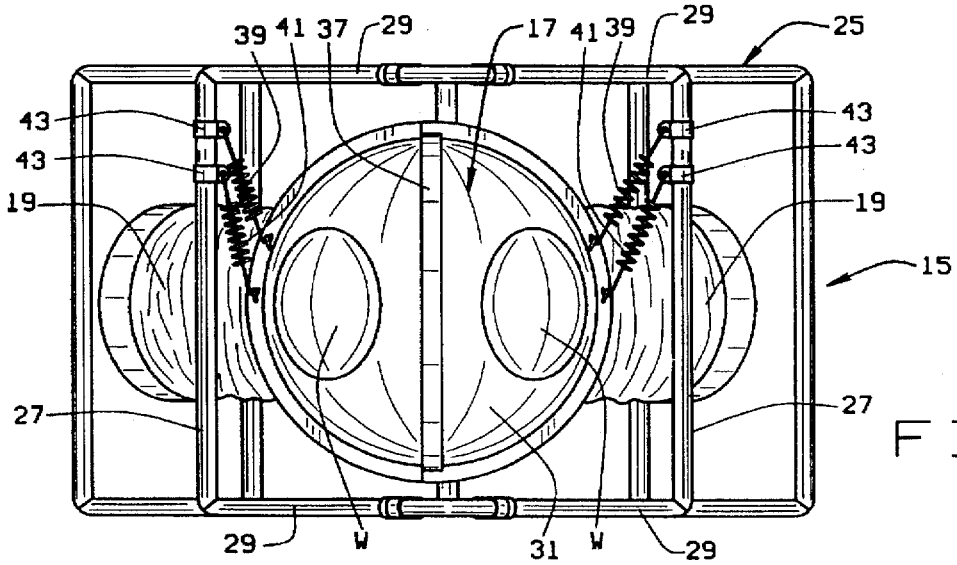
FIG. 5 is a front elevational view of the movable recreational equipment device illustrating movement of the device from right to left.

For an understanding of the manner in which the spaced pairs of coil springs 39, 41 on each side of the enclosure 17 work in conjunction with the spring mounted cable 45, reference is made to FIGS. 3–5 and 6–7 of the drawings. Referring first to the operation of the spaced pairs of coil springs 39, 41, FIG. 3 of the drawings illustrates a static or non-moving condition of the enclosure 17 relative to the support 25. When an occupant enters the enclosure 17, the enclosure 17 may be moved in a multi-directional movement relative to the support 25. As shown in FIG. 4 of the drawings, the enclosure 17 is moved to the right as well as downwardly from the position illustrated in FIG. 3, thus causing the leftmost spaced pair of coil springs 39, 41 to be extended while the rightmost spaced pair of coil springs 39, 41 are pivotally moved at their ends from the position illustrated in FIG. 3 to that shown in FIG. 4. In FIG. 5 of the drawings, the enclosure 17 is shown as being moved to the left and downwardly relative to the position illustrated in FIGS. 3 and 4, causing an extension of the rightmost spaced pair of coil springs 39, 41 while the leftmost pair of coil springs 39, 41 are pivotally mounted at their ends in a similar manner as described above. As a result, the occupant within the enclosure 17 can cause a multi-directional movement, either laterally to the right or left, as well as downwardly and upwardly relative to the static or non-moving position illustrated in FIG. 3 of the drawings.

To facilitate the multi-directional movement of the enclosure 17 relative to the support 25 while stabilizing the enclosure 17 relative to the support 25, a spring mounted cable 45 extends between and is positioned below the spaced opposed pairs of coil springs 39, 41, as best illustrated in FIGS. 2 and 6–7 of the drawings. The spring mounted cable 45 has one end attached to the rear semi-circular strip 37 while the other end is attached by way of a strap 43 to one of the vertical struts 27, as shown in FIG. 2 of the drawing. As a result, when the enclosure is moved from its static position shown in FIG. 3 of the drawing to the various positions where multi-directional movement is permitted, such as shown in FIGS. 4–5 of the drawing, the spring associated with the spring mounted cable 45 will move from the static position shown in FIG. 6 to that illustrated in FIG. 7 of the drawings where it is extended during the aforementioned multi-directional movement of the enclosure 17. At the same time, the spring mounted cable 45 will stabilize the enclosure 17 since it is mounted below and positioned between the spaced and opposed pairs of coil springs 39, 41, thus acting to both facilitate while stabilizing the multi-directional movement of the enclosure 17 relative to the support 25.

From the foregoing, it will now be appreciated that the movable recreational equipment device of the present invention, whether used independently or in conjunction with the recreational play system illustrated in FIG. 8 of the drawings, provides a smooth, safe and controlled fluid or resilient movement of an enclosure 17 relative to the support 25 in a predetermined path or paths. Such predetermined path can be in generally opposed directions, and can include a plurality of predetermined paths such as the multi-directional movement of the enclosure in the three directional movement described above. It will be understood that the movement of the enclosure is also accomplished without separation from other components in a recreational play system environment.

As various changes could be made in the above constructions without departing from the scope of the invention, it is intended that all matter contained in the above description or shown in the accompanying drawings shall be interpreted as illustrative and not in a limiting sense.

We claim:

1. A movable recreational equipment device, including:

an enclosure having at least one opening for entry of an occupant;

proximate support structure immediately adjacent to generally opposed areas of the enclosure for suspending the enclosure above a floor surface;

spring means extending between the proximate support structure and generally opposed areas of the enclosure for controlled multi-directional movement of the enclosure relative to the support in order to provide controlled multi-directional movement of the enclosure relative to the support when an occupant enters the enclosure:

means generally intermediate the spring means and extending between the proximate support structure and enclosure for limiting multi-directional movement of the enclosure relative to the support within a predetermined confined path.

2. The device as defined in claim 1 in which the enclosure includes an enclosed center section with interconnected outwardly extending spaced tubular leg sections.

3. The device as defined in claim 2 in which the spring means for controlled multi-directional movement of the enclosure relative to the support extends between the enclosed center section of the enclosure and the support.

4. The device as defined in claim 3 in which the spring means for controlled multi-directional movement of the enclosure relative to the support extends from generally opposite areas of the enclosed center section and the support.

5. The device as defined in claim 4 in which the spring means for controlled multi-directional movement of the enclosure relative to the support extends from generally opposite areas of the enclosed center section include springs.

6. The device as defined in claim 5 in which the springs include a spaced pair of coil springs on each side of the center section.

7. The device as defined in claim 6 in which each pair of spaced coil springs are attached to the enclosed center section at one end and to a vertical support element at an opposite end.

8. The device as defined in claim 7 in which the enclosed center section includes two half sections which are joined together by a surrounding flange, and each pair of spaced coil springs are attached at one end to the surrounding flange.

9. The device as defined in claim 8 in which the means limiting multi-directional movement includes a spring mounted cable extending between the enclosed center section and the support, the cable being located between and substantially below each pair of spaced coil springs to facilitate multi-directional movement of the enclosure while stabilizing the enclosure relative to the support.

10. The device as defined in claim 1 wherein the enclosure is a component in a recreational equipment play system, said enclosure being connected to flexible components while permitting movement of the enclosure relative to such flexible components.

11. A movable recreational equipment component, including:

an enclosure having a central section with interconnected outwardly extending spaced generally tubular shaped flexible legs capable of attachment to complementary shaped tubes in recreational tubular play equipment;

proximate support structure immediately adjacent to generally opposed areas of the enclosure for suspending the enclosure above a floor surface;

at least one spring extending from each of the generally opposed areas of the central section and connected to the proximate support structure in order to permit limited resilient movement of the enclosure relative to the proximate support structure when an occupant enters the enclosure while the tubular shaped flexible legs of the enclosure remain connected to the complementary shaped tubes; and means generally intermediate the spring means and extending between the proximate support structure and enclosure for limiting multi-directional movement of the enclosure relative to the support within a predetermined confined path.

12. The component as defined in claim 11 and including a spring mounted cable that extends between the central section and support in an area between and substantially below the generally opposite areas of the central section from which each spring extends.

13. The component as defined in claim 12 in which the central section includes two half sections connected to each other by a surrounding flange, and each spring in generally opposite areas of the central section being connected to the surrounding flange.

14. The component as defined in claim 13 and including a pair of spaced springs extending from the surrounding flange on each of generally opposite areas of the central section, each pair of spaced springs being connected to a separate vertical support element of the support.

15. The component as defined in claim 11 wherein the generally tubular shaped legs flexible generally tube like elements made from webbing material.

* * * * *